United States Patent [19]

Bakalowits et al.

[11] 4,127,892

[45] Nov. 28, 1978

[54] LIGHTED ELEMENT FOR DECORATION

[75] Inventors: Friedhelm Bakalowits, Vienna; Carl Zalloni, Salzburg, both of Austria

[73] Assignee: E. Bakalowits Sohne Gesellschaft m.b.H., Vienna, Austria

[21] Appl. No.: 791,207

[22] Filed: Apr. 27, 1977

[30] Foreign Application Priority Data

Apr. 27, 1976 [AT] Austria ..... 3091/76

[51] Int. Cl.[2] ..... F21V 7/04

[52] U.S. Cl. ..... 362/32; 362/311; 362/405; 362/806

[58] Field of Search ..... 362/31, 32, 311, 405, 362/406, 806

[56] References Cited

U.S. PATENT DOCUMENTS 3,828,201 8/1974 Allen ..... 240/6.4 W X

*Primary Examiner*—Stephen J. Lechert, Jr.

*Attorney, Agent, or Firm*—Imirie, Smiley & Guay

[57] ABSTRACT

The element for decoration comprises a crystal glass bar, which is formed with a cavity that extends through the bar along its longitudinal center line and is open at both ends, and a wire which extends through the cavity and serves to attach the bar.

8 Claims, 5 Drawing Figures

Figure 1:
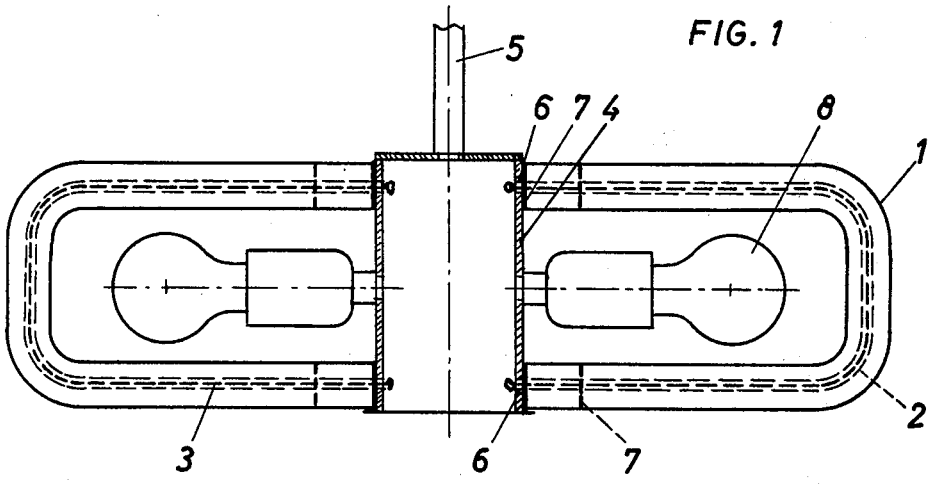

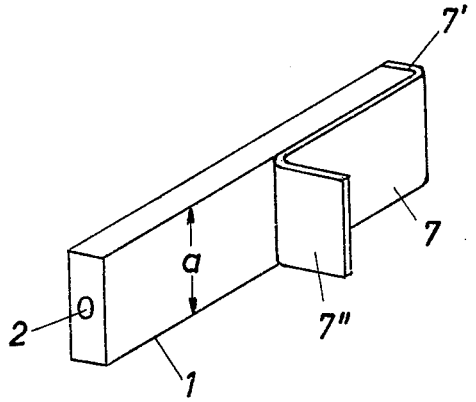
FIG. 3
FIG. 4
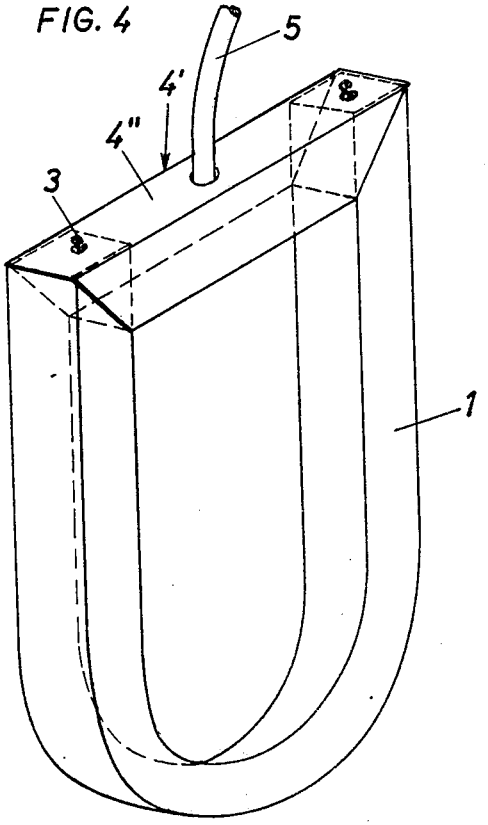
FIG. 5
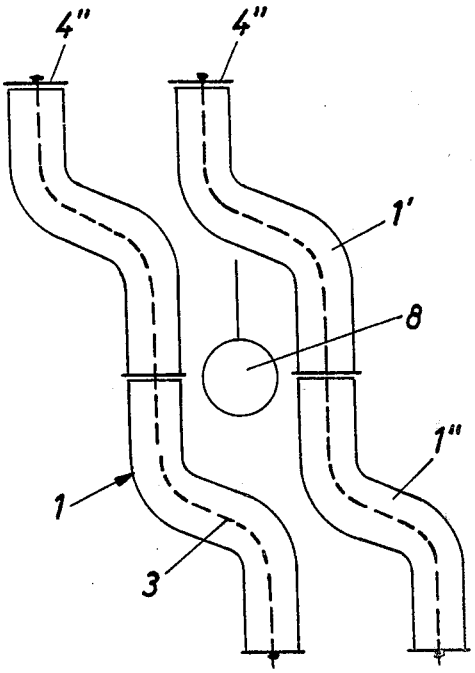

LIGHTED ELEMENT FOR DECORATION

SUMMARY OF THE INVENTION

A lighting fixture comprises a carrier, at least one crystal glass bar and a wire, which extends through said bar throughout the length thereof and by which the bar is attached at least at one end thereof to the carrier in such a manner that the bar is disposed in close proximity to a light source for emitting light through the crystal bar.

The invention relates to an element for decoration, which is particularly intended for use in lighting fixtures and distinguishes in that it can easily be assembled and produces special optical effects.

It is known to provide antique chandeliers having curved branches, which extend radially outwardly in a starlike array and carry candle-shaped bulbs. These branches are composed of short glass sections and carry the electric leads. Each branch is connected by a clamping element to a common carrier, which forms a continuation of the suspension cable. Each clamping element engages the respective branch between two glass sections. In such chandeliers, the branches are disposed below the bulbs, each of which is carried by the respective branch on a candle-shaped sleeve, and the branches do not or do not sufficiently contribute to the luminous efficiency of the lighting fixture and to the dispersion of light effected by the same.

It is an object of the invention to provide an element which is intended for decoration in a manner which is similar to the use of arms of pleasing shape in antique chandeliers and can be used in arrays of various configurations and when used in lighting fixtures can transmit the light emitted by a light source.

The interior for decoration according to the invention comprises a crystal glass bar, which is formed with a cavity that extends through the bar along its longitudinal center line and is open at both ends, and a wire, which extends through the cavity and serves to attach the bar.

The term "wire" is to be understood in its broadest meaning. In most cases a thin steel wire will be used, but thin filaments of plastics material, ropes of any desired plastics material or of metal wires or the like and equivalent other supporting and attaching elements may also be used within the scope of the invention.

The crystal glass bar may be straight or curved as desired. It may be attached at one end or at both ends to a carrier by means of the wire extending through the bar. When the bar is attached only at one end, the wire end disposed at the free end of the crystal bar is secured to the latter. In this case, the opening in the bar may be closed by welding. In lighting fixtures, crystal bars curved in U-shape are preferred and are secured at both ends to a carrier in the manner which has been described. Manually shaped curved bars of crystal glass may be used to produce special style effects and optical effects and these curved bars may also be colored.

Figure 2:
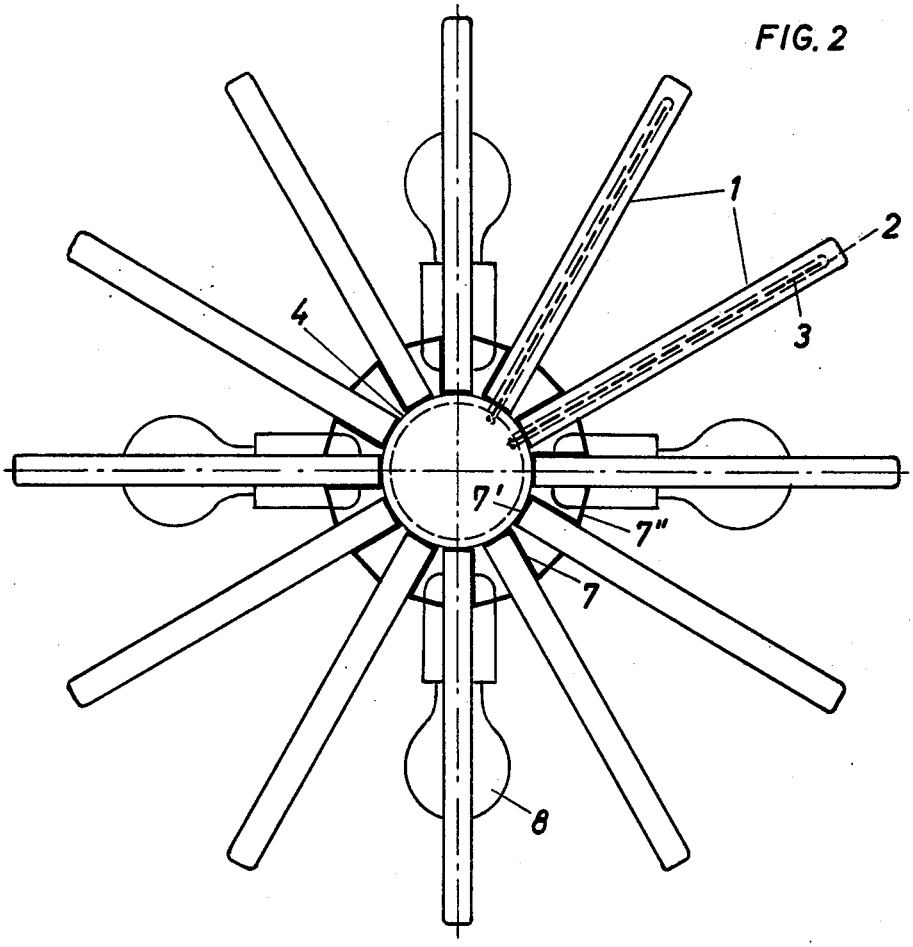

Further details of the invention will be explained more fully with reference to the drawing, in which:

FIG. 1 is an axial longitudinal sectional view showing a lighting fixture which comprises elements for decoration in accordance with the invention, FIG. 2 is a top plan view showing the lighting fixture of FIG. 1, FIG. 3 shows a detail of the lighting fixture of FIGS. 1 and 2, FIG. 4 shows a suspended element for decoration according to the invention and FIG. 5 a second embodiment of a suspended element for decoration according to the invention.

In all embodiments, the element for decoration is designated 1. As has been mentioned, it comprises a crystal glass bar, which is formed with a passage 2, which extends along the longitudinal center line of the bar 2 and serves to accommodate an attaching wire 3.

The lighting fixture shown in FIGS. 1 to 3 comprises crystal glass bars 1 which are curved in U-shape and extend in respective vertical planes in a starlike array and are secured to a central vertical cylindrical carrier tube 4. This tube can be suspended from the ceiling of a room by means of a rod 5, a rope or the like. To secure the bars 1 to the carrier tube 4, the wires 3 of the bars are threaded through suitable holes 6 of the carrier tube 4 and are anchored within the latter by being knotted or other measures. To locate the bars 1 in the desired position relative to each other, spacers 7 are provided, which consist each of a sheet metal member that is bent in Z-shape and has a width equal to the height *a* of the bar 1. One flange of the spacer covers the end face of the bar 1 and is gripped between the latter and the pipe 4. The other flange 7'' of the spacer 7 is approximately concentrically disposed and holds adjacent bars 1 spaced apart. In the present embodiment, each end is provided with a spacer 7 and the wire 3 extends through the flange 7'' of said spacer and through the wall of the tube 4. Alternatively, such spacer 7 may be provided only at one end of each bar 1.

The light sources 8 consist in the present case of incandescent bulbs and are disposed within individual ones or all of the spaces which are enclosed by the U-shaped bars 1 and the tube 4 so that the light emitted by said light sources is transmitted by the bars to produce a particularly desirable lighting effect. In the present arrangement and preferably in all other lighting fixtures which comprise bars according to the invention the electric leads, not shown, extend outside the bars 1.

In the embodiment of the lighting fixture shown in FIG. 1, a separate carrier 4' is provided for each U-shaped bar 1. This carrier consists in the present case of a hollow box section having inwardly converging, beveled ends, to which the ends of the U-shaped bar 1 are applied. The U-shaped bar 1 is anchored at the top wall 4'' of the hollow section 4' by the wire 3, which extends through the wall 4''. This attachment is similar to the one used in the preceding embodiment. The hollow sections 4' are secured to a wall, ceiling or the like by means of a carrying rod 5, a rope or the like. The carrying rod may be shaped in accordance with the desired configuration of the array. The light source may be disposed within the space enclosed by the curved bar 1 or, where a plurality of U-shaped bars are suspended one beside the other, may be disposed within the lateral projection of the space enclosed by the U-shaped bars, which may differ in length, if desired.

The bars 1 may have any other configuration and in the simplest form may consist of straight bars which are suspended from a plate-shaped or annular carrier and disposed around a light source. Each bar may also consist of a plurality of mating sections. For instance, FIG. 5 shows an embodiment in which two angled bar sections 1', 1'' are connected in series to form an element 1 for decoration. A plurality of these elements 1 arranged in alternation with light sources 8 may be suspended from respective carriers 4'' or from a common carrier.

In this case one wire 3 may extend through all bar sections 1', 1'', which belong to a common element for decoration, or each section may comprise a separate wire, which is tied to the end of the wire of the succeeding section.

Finally, the elements 1 for decoration may be used for other purposes of decoration, where the elements are not directly combined with light sources and perform their fuction only under the action of the room illumination or of daylight.

What is claimed is:

1. A lighting fixture comprising an element for decoration including a carrier, at least one crystal glass bar, and a wire which extends through said bar throughout the length thereof and by which the bar is attached at least at one end thereof to the carrier, and a light source disposed in close proximity to said bar for emitting light through the crystal bar.

2. A lighting fixture according to claim 1, wherein the crystal glass bar is curved in U-shape and is secured at both ends to said carrier, and the light source is disposed within the space enclosed by the U-shaped bar or in close proximity thereto in the projection of the surface enclosed by the U-shaped bar.

3. A lighting fixture according to claim 1, wherein a plurality of crystal glass bars bent in U-shape are disposed in vertical planes and angularly spaced apart and secured to a vertical carrier.

4. A lighting fixture according to claim 1, wherein said carrier is cylindrical and a plurality of said crystal glass bars are attached at both ends thereof to said cylindrical carrier, the wire extending through each bar extends through the carrier at both ends of the rod, and means anchoring each end of each wire to said carrier.

5. A lighting fixture according to claim 1, comprising a plurality of bars, and means securing at least one end of each bar to the carrier and includes interposed means for spacing the respective bar from an adjacent bar.

6. A lighting fixture according to claim 5, wherein said interposed spacing means includes a spacer between two adjacent bars and comprising a substantially Z-shaped element, one flange of which is secured between the respective bar and the carrier, the respective attaching wire extending through said one flange, the other flange determining the spacing, and the web disposed between the two flanges engages the bar next to the gripped flange.

7. A lighting fixture according to claim 1, wherein a plurality of light sources are disposed within the spaces enclosed by said crystal glass bars.

8. A lighting fixture according to claim 7 wherein each said light source is disposed within the space surrounded by a respective one of said glass bars.

* * * * *